US010703387B2

(12) United States Patent
MacDonald

(10) Patent No.: US 10,703,387 B2
(45) Date of Patent: Jul. 7, 2020

(54) CABLE SUPPORT SYSTEM

(71) Applicant: Charles Henry MacDonald, Willits, CA (US)

(72) Inventor: Charles Henry MacDonald, Willits, CA (US)

( * ) Notice: Subject to any disclaimer, the term of this patent is extended or adjusted under 35 U.S.C. 154(b) by 0 days.

(21) Appl. No.: 15/210,836

(22) Filed: Jul. 14, 2016

(65) Prior Publication Data

US 2018/0017187 A1 Jan. 18, 2018

(51) Int. Cl.
*B61B 12/02* (2006.01)
*B61B 7/00* (2006.01)
*A62B 35/00* (2006.01)

(52) U.S. Cl.
CPC ..... *B61B 12/02* (2013.01); *B61B 7/00* (2013.01); *A62B 35/0087* (2013.01)

(58) Field of Classification Search
CPC ..... F16L 3/012; F16L 3/10; F16L 3/18; B61B 12/026; B66D 1/23; B66D 2700/0183; B66D 2700/0191; B63B 21/08
USPC ..... 248/55, 58, 67.5; 254/389, 395, 407
See application file for complete search history.

(56) References Cited

U.S. PATENT DOCUMENTS 104,284 A * 6/1870 Donnely ..... F16L 3/18 104/276
121,423 A * 11/1871 Robinson ..... B63B 21/08 114/101
522,524 A * 7/1894 Hook ..... B63B 21/08 114/101
813,588 A * 2/1906 Rollins ..... F16L 3/18 16/98
1,062,373 A * 5/1913 Swam ..... F16L 3/18 248/55
1,220,343 A * 3/1917 Kimball ..... F16L 3/18 138/106
1,524,310 A * 1/1925 Post ..... B61L 7/021 248/55
1,563,212 A * 11/1925 Madiar ..... A01K 1/04 119/784

(Continued)

FOREIGN PATENT DOCUMENTS

FR 2588445 A1 * 4/1987 ..... A01K 1/04
GB 585942 A * 2/1947 ..... F16L 3/18
WO WO 2007122029 A1 * 11/2007 ..... A61B 6/4441

*Primary Examiner* — Kimberly T Wood
(74) *Attorney, Agent, or Firm* — Lamon Patent Services; Cynthia S. Lamon

(57) ABSTRACT

A cable carrier apparatus has a bracket having a vertical mounting surface interface for mounting securely to a post, wall, or other stable support, and a horizontal portion, a first roller rotatable on a vertical post anchored to be stationary relative to the frame bracket, with the first roller positioned below the horizontal portion of the bracket, the first roller having a circumferential groove symmetrical around an axis of the post and about a horizontal plane, the groove having a cross-section with a radius describing a portion of a semicircle, but less than a full semicircle, and a second roller matching the first roller and rotatable on a second post having an axis, the second roller mounted to be translatable against spring force away from the first roller, wherein a traveler translating on a cable being held between the two rollers traverses through the rollers, maintaining the cable between the rollers.

6 Claims, 6 Drawing Sheets

(56) References Cited

U.S. PATENT DOCUMENTS

| | | | | | |
|---|---|---|---|---|---|
| 1,763,775 | A * | 6/1930 | Gottwald | F16L 3/18 | 138/113 |
| 1,845,183 | A * | 2/1932 | Post | F16L 3/18 | 246/415 R |
| 2,680,006 | A * | 6/1954 | Brock | E21B 19/02 | 254/395 |
| 2,816,734 | A * | 12/1957 | Crofoot | B65H 75/4402 | 114/181 |
| 3,097,892 | A * | 7/1963 | Newbury | E21B 7/046 | 248/55 |
| 3,295,801 | A * | 1/1967 | McDowall | F16C 27/063 | 248/55 |
| 3,375,045 | A * | 3/1968 | Zeidler | F16C 29/045 | 226/180 |
| 3,648,664 | A * | 3/1972 | Nunley | A01K 1/04 | 119/785 |
| 3,678,903 | A * | 7/1972 | Ferraro | A01K 1/04 | 119/784 |
| 5,339,773 | A * | 8/1994 | Van Druff | A01K 1/04 | 105/141 |
| 6,364,256 | B1 * | 4/2002 | Neider | F16L 3/18 | 248/55 |
| 6,886,498 | B1 * | 5/2005 | Rochette | A01K 1/04 | 119/784 |
| 8,708,315 | B2 * | 4/2014 | Wilcox | B66D 1/36 | 254/383 |
| 8,944,389 | B2 * | 2/2015 | Neuber | B25J 19/0025 | 248/75 |

* cited by examiner

CABLE SUPPORT SYSTEM

BACKGROUND OF THE INVENTION

1. Field of the Invention

The present invention is in the technical area of cable runs, and pertains more particularly to support devices for configuring cable runs and passing travelers connected to loads.

2. Description of Related Art

It is well known in the arts to suspend a cable from one anchor point to another, and to harness a mechanical traveler to such a cable, the traveler enabled to slide or roll along the suspended cable, connected to a load of some sort intended to be supported or constrained by the cable in a path defined by the cable between the anchor points. Dog runs are one simple example. Another example is safety equipment for such as steel workers in construction.

A problem with such cable runs is that they are typically limited to the cable length between the anchor points. It is known to provide a plurality of anchor points, and to support cable from one to another and another, in a pattern, but typically one must disconnect the mechanical traveler from one cable and reconnect to another, to move the connected load to the next cable run. This process is labor intensive at best, and in the circumstance of safety equipment can be dangerous as well, as a worker disconnects a harness from one run and reconnects to another.

BRIEF SUMMARY OF THE INVENTION

In one embodiment a pass-through cable carrier apparatus is provided, comprising a frame bracket having a vertical mounting surface interface for mounting securely to a post, wall, or other stable support, and a horizontal portion, a first roller rotatable on a first vertical post anchored to be stationary relative to the frame bracket, with the first roller positioned below the horizontal portion of the frame bracket, the first roller having a first circumferential groove symmetrical around a central axis of the post and about a horizontal plane, the groove having a cross-section with a radius describing a substantial portion of a semicircle, but slightly less than a full semicircle, and a second roller matching the shape and dimensions of the first roller and rotatable on a second vertical post having a central axis, the axes of the first and second vertical posts lying in a plane at a right angle to the mounting surface of the frame bracket, the second roller mounted to be translatable against spring force away from the first roller.

In one embodiment the second vertical post is mounted in a translatable carriage guided by shafts in bores in a guide block, wherein the translatable carriage is urged toward the first roller by one or more springs. Also in one embodiment the second vertical post is mounted at an upper end pivotally at a free end of a horizontal cantilever arm mounted at an opposite end pivotally at a position such that rotation of the cantilever arm about the pivot causes the second roller to move away from the first roller. Also in one embodiment the cantilever arm bears on one side against a leaf spring that urges the cantilever arm in a rotary direction to move the second roller against the first roller. In one embodiment the first and the second rollers are cylinder shapes with the grooves cut to be symmetrical about a plane orthogonal to a central axis of the cylinder, leaving cylindrical lands above and below the grooves that may bear on one another when the rollers are touching.

In one embodiment the first and the second rollers are spherical shapes with the grooves cut to be symmetrical about a plane passing through a center of the spherical shape of each roller. Also in one embodiment the frame bracket has two vertical mounting surface interfaces, one on each end of the horizontal portion, extending downward from the horizontal portion, enabling mounting to a wall, post or other vertical support, with the translatable roller nearer to the vertical support, or alternatively away from the vertical support. Also in one embodiment the apparatus further comprises a traveler having a body symmetrical about a central axis, with a length and a circumference along a central portion of the length, the circumference having a radius equal to the radii of the grooves of the first and second rollers, a tapered shape from the central portion to each end of the body, a tongue extending from the central portion of the length of the body at a right angle to the central axis of the traveler, the tongue having a length along the body substantially less than the length of the central portion of the body, and a thickness substantially less than the diameter of the central portion of the body, the body further having a central bore along the axis, through which a cable passes, that also passes through the pass-through cable carrier apparatus between the rollers. And in one embodiment the traveler is urged to pass between the rollers, such that a first tapered end guides the traveler into contact with the grooves in the rollers, the rollers roll upon the traveler body when the central round portion of the traveler body is between the rollers, the traveler urges the rollers apart providing passage between the rollers for the tongue of the traveler while supporting the cable, and the tapered opposite end of the traveler body allows the rollers to close as the traveler passes through, the closed rollers capturing and supporting the cable.

In another aspect of the invention a method for supporting a cable while allowing a cable traveler to pass through is provided, comprising steps of (a) mounting a pass-through cable-carrier apparatus to a post, wall, or other stable support, by a vertical mounting surface of a frame bracket having a horizontal portion extending from an upper extremity of the vertical mounting interface, the apparatus comprising a first roller rotatable on a first vertical post mounted to be stationary relative to the frame bracket, with the first roller positioned below the horizontal portion of the frame bracket, the first roller having a first circumferential groove symmetrical around a central axis of the post and about a horizontal plane, the groove having a cross-section with a radius describing a substantial portion of a semicircle, but slightly less than a full semicircle, and a second roller matching the shape and dimensions of the first roller and rotatable on a second vertical post having a central axis, the axes of the first and second vertical posts lying in a plane at a right angle to the mounting surface of the frame bracket, the second roller mounted to be translatable against spring force away from the first roller, (b) passing a cable through an opening formed by the grooves of the first and second rollers in contact, (c) passing the cable through a bore through the length of a cable traveler having a body symmetrical about a central axis of the bore, with a length and a circumference along a central portion of the length, the circumference having a radius equal to the radii of the grooves of the first and second rollers, a tapered shape from the central portion to each end of the body, a tongue extending from the central portion of the length of the body at a right angle to the central axis of the traveler, the tongue having a length along the body substantially less than the length of the central portion of the body, and a thickness substantially less than the diameter of the central portion of the body, and (d) causing the traveler to pass between the rollers, such that a first tapered end guides the traveler into contact with the grooves in the rollers, the rollers roll upon the traveler body when the central round portion of the traveler body is between the rollers, the traveler urges the rollers apart providing passage between the rollers for the tongue of the traveler while supporting the cable, and the tapered opposite end of the traveler body allows the rollers to close as the traveler passes through, the closed rollers capturing and supporting the cable after the traveler passes.

In one embodiment the method further comprises a step mounting a plurality of pass-through cable carrier apparatuses in a pattern to a plurality of stable supports, the pass-through apparatuses spaced apart in a non-linear pattern, anchoring the cable to fixed anchors at opposite ends of the cable, and passing the traveler along the cable through individual ones of the pass-through cable carrier apparatuses. Also in one embodiment individual ones of the pass-through cable carrier apparatuses are mounted to have the translatable roller nearer the stable support, or away from the stable support, as needed to provide for tension on the cable without tending to urge the roller apart.

BRIEF DESCRIPTION OF THE SEVERAL VIEWS OF THE DRAWINGS

FIGS. 3*a*, 3*b* and 3*c* illustrate a cable traveler in an embodiment of the invention.

DETAILED DESCRIPTION OF THE INVENTION

Figure 1:
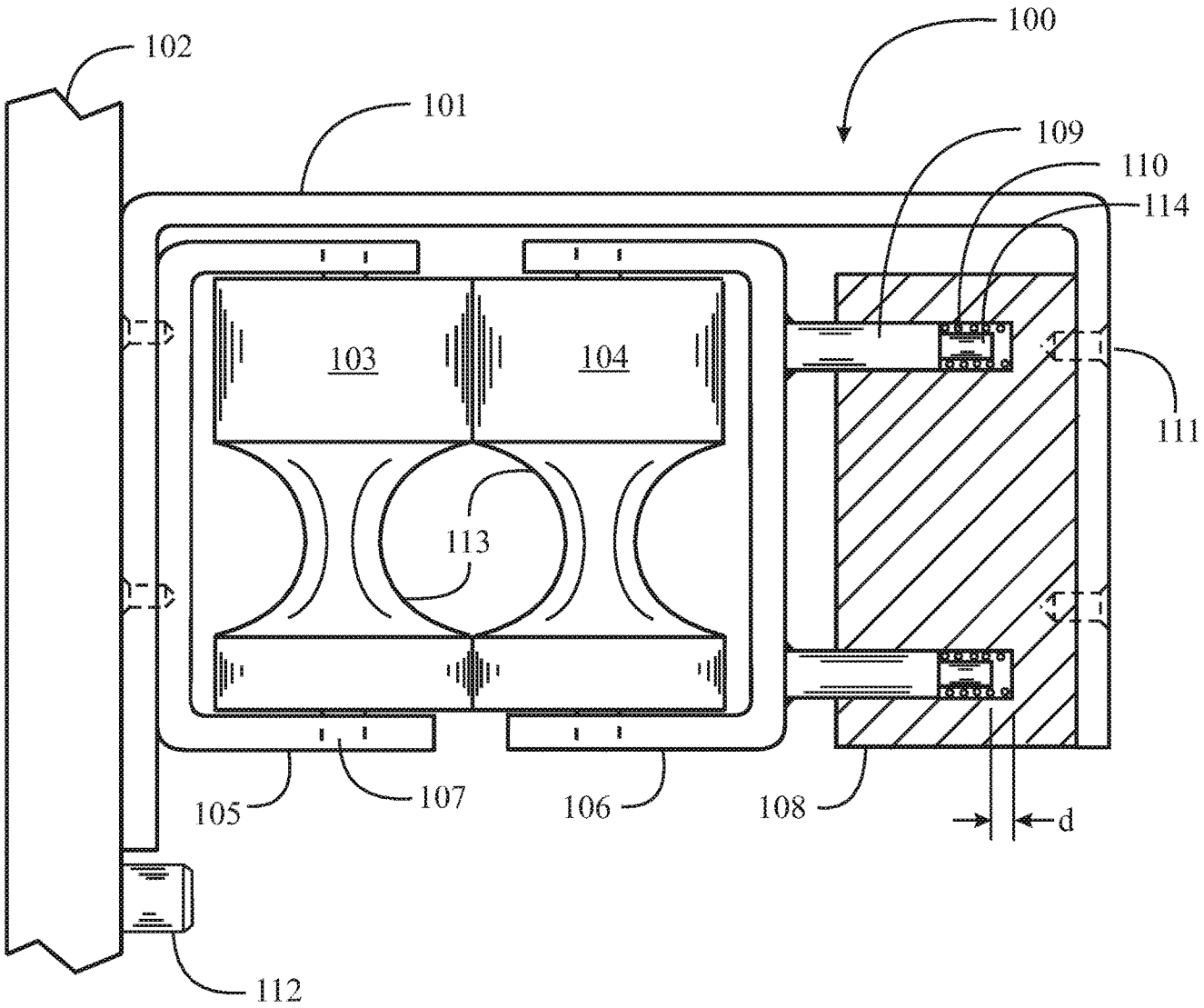
FIG. 1 is a side elevation view of a pass-through cable carrier in an embodiment of the invention.

FIG. 1 is a side elevation view of a pass-through cable carrier 100 in an embodiment of the invention. Cable carrier 100 is supported by an external frame 101 bolted typically by conventional fasteners 112 to a structure 102, such as a post, pole, wall or other stable structure. A first bracket 103 serves as support for a roller 103 mounted above and below by a shaft and bearings 107, such that the roller may freely rotate about its longitudinal axis. Roller 103 has a groove 113 that is circular in shape, but describes only a major portion of a circle, as is described below in more detail.

A second bracket 106 serves as support for a second roller 104 that has the same shape and dimensions as the first roller 103, and is supported on a shaft and bearings 107 as is roller 103. In the circumstance illustrated in FIG. 1 rollers 103 and 104 are in contact. Bracket 106 has two or more shafts 109 extending in a direction at a right angle to the axes of rollers 103 and 104. In this particular embodiment there are four shafts 109 arranged in a rectangular pattern. Shafts 109 slip fit into matching bores in a guide block 108 such that bracket 106 may translate to a limited extent in the direction of shafts 109. In FIG. 1 guide block 108 is shown in section through two of the four bores for shafts 109.

Each shaft 109 has a portion 114 of lesser diameter than the maximum shaft diameter, such that a strong compression spring 110 may be located around the lesser-diameter extension. Compression springs acting on all of the shafts 109 urge bracket 106 and hence roller 104 toward roller 103 until contact is made. By managing the length and spring rate of springs 110, the force applied to roller 103 by roller 104 may be controlled.

In FIG. 1 it may be seen that, with bracket 106 urged by springs 110 to contact roller 103 by roller 104, there is a space of dimension "d" between the end of shafts 109 and the depth of the bores within which the shafts are constrained and guided. This dimension limits the distance roller 104 may be withdrawn from roller 103. The significance and purpose of this limitation is made clear in further figures and description below.

Figure 2:
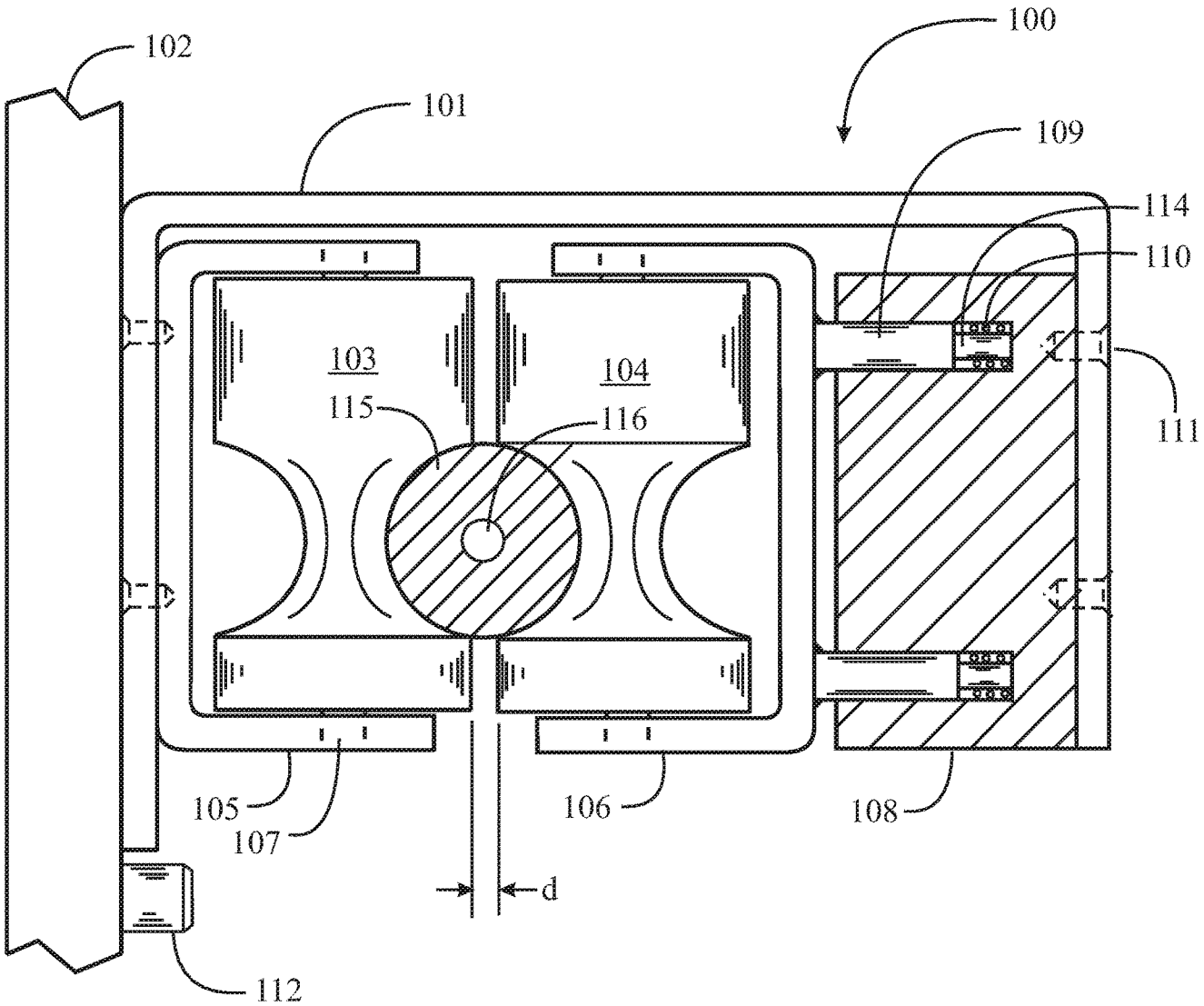
FIG. 2 is the side elevation view similar to FIG. 1 illustrating the rollers separated to a maximum extent in an embodiment of the invention.
Figure 5A:
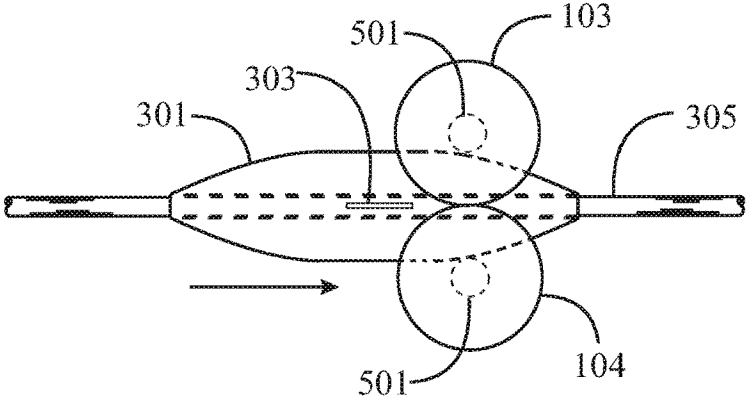
FIGS. 5*a*, 5*b*, 5*c*, 5*d* illustrate how the traveler riding a cable interacts with a pass-through carrier according to an embodiment of the invention.

FIG. 2 is the side elevation view similar to FIG. 1 illustrating the rollers separated to a maximum extent in an embodiment of the invention. The separation is accomplished in this example by moving a traveler 115, having a round cross-section through the rollers. Traveler 115 has a circular cross-section of a maximum radius equal to the radius of the grooves 113 in FIG. 1 for rollers 103 and 104, and in this example a through hole 116 of a lesser diameter. Traveler 115 is described in further detail, and its use is described, as traveler 301 in FIGS. 5*a*, 5*b* and 5*c* below.

It was described above in regard to FIG. 1 that grooves 113 describe less than a full half-circle. The difference in this example is just sufficient that fully round traveler 115 causes rollers 103 and 104 to separate by dimension "d", which is the distance described in FIG. 1 to which separation is limited by the length of shafts 109 and the bores that guide the shafts in guide block 108. The amount of separation may be very small, or considerably larger, depending on design and scale of the pass-through carrier.

Figure 3A:
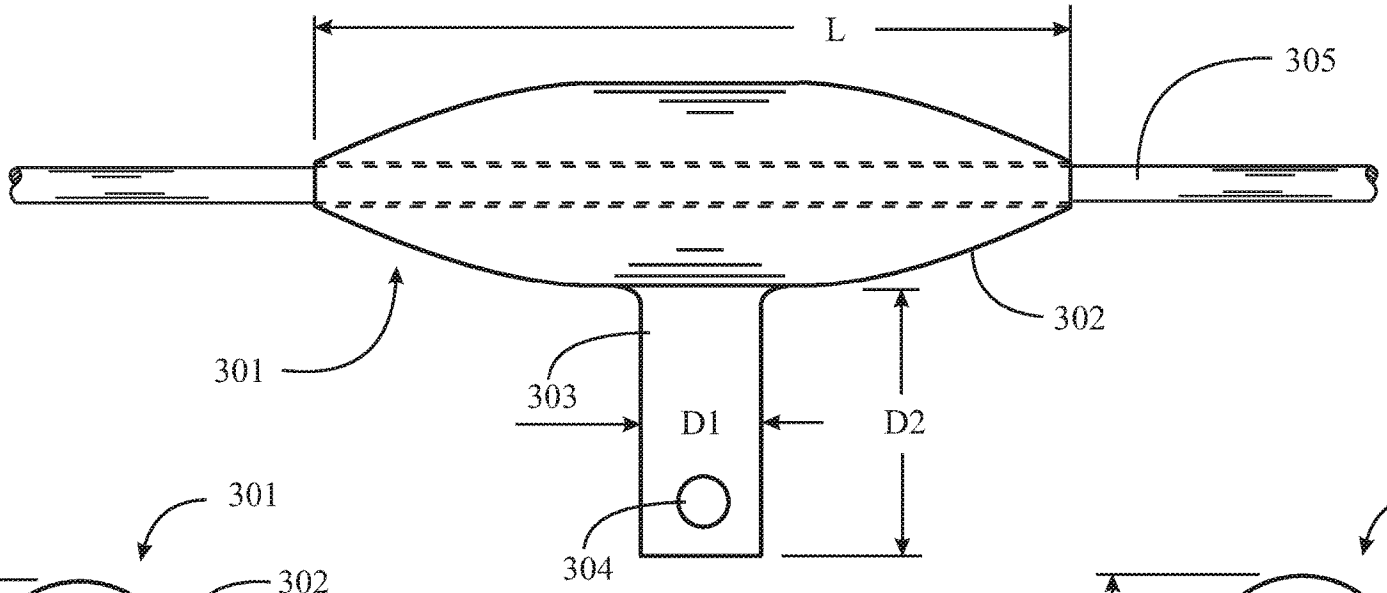
Figure 3B:
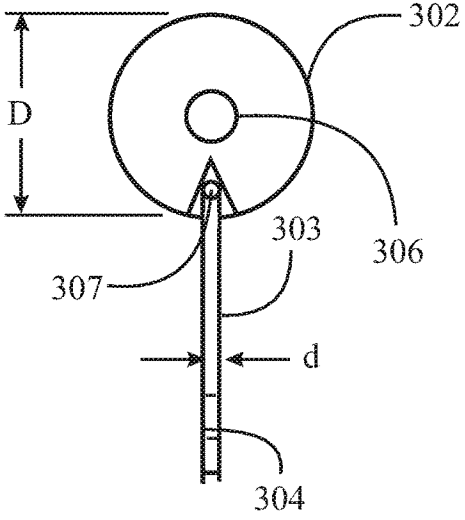

FIG. 3*a* is a side elevation view of a cable traveler 301 in an embodiment of the invention, and FIG. 3*b* is an end view of cable traveler 301 of FIG. 3*a*. Cable traveler 301 comprises a body 302 having a maximum diameter D for a portion D1 of length L centered on the length. Traveler 301 in this example is the same as traveler 115 of FIG. 3. A connector tongue 303 extends dimension D2 from body 302 centered on the length of body 302, and has a hole 304 near the end away from the traveler body, for connecting to a harness, a dog leash, or other device that may be enabled to follow a cable run with the traveler. In other embodiments the connection from tongue 303 need not be by a hole 304, but could be any of a number of fasteners and techniques. A bore 306 on the long axis of the traveler body is for following cable 305, which may be a metal cable comprising braided strands, a cord, a rope, or other material. Bore 306 is somewhat larger in diameter than cable 305, so the traveler may easily travel along the cable, supported at intervals by pass-through carriers of the sort described with reference to FIGS. 1 and 2.

FIG. 3*c* illustrates an implementation in which tongue 303 is engaged by a pivot at point 307 to allow the tongue to assume an angle other than 90 degrees with the body of the traveler. For example the tongue may pivot forming an angles less than 90 degrees in a direction of travel of the traveler 301. The skilled person will understand that this may be accomplished in a variety of ways.

Figure 3B:
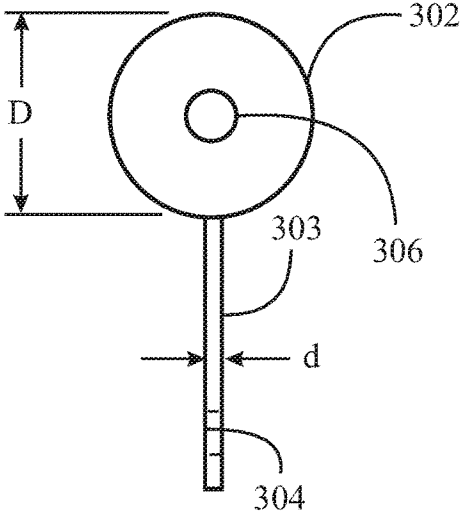
Figure 4:
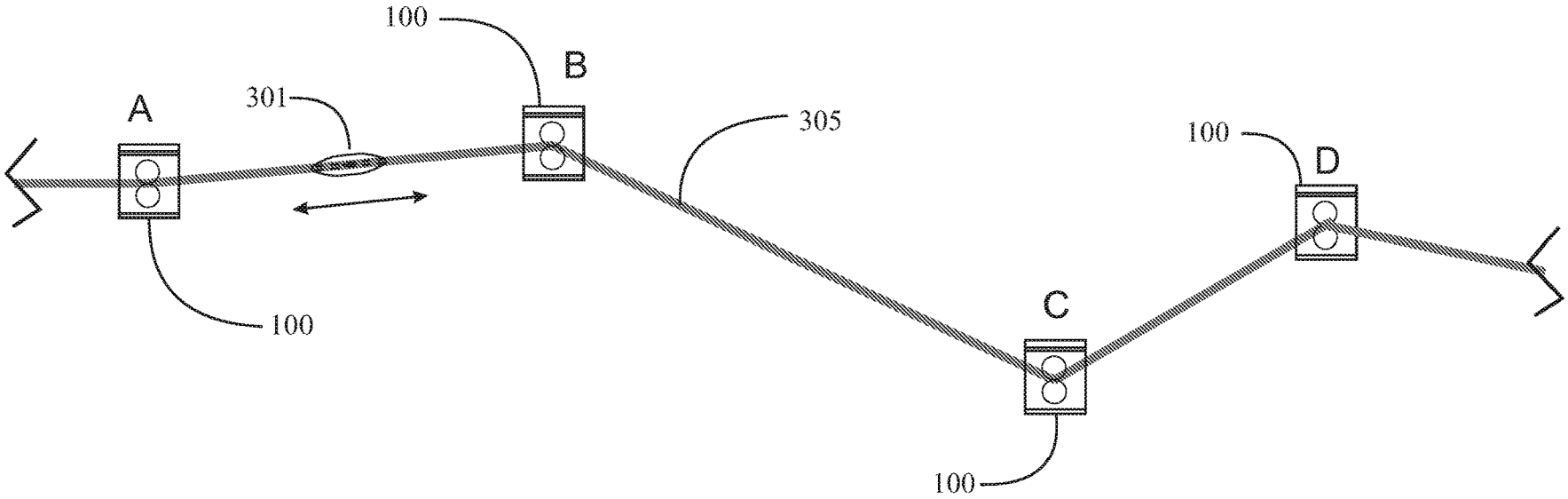
FIG. 4 illustrates a top plan view of a cable run with multiple pass-through carriers in an embodiment of the invention.

FIG. 4 illustrates a plan view from above of a cable run using four pass-through cable carriers as described relative to FIGS. 1 and 2. Cable 305 is anchored securely on opposite ends and supported by pass-through carriers 100 labeled A, B, C and D. As seen in the layout, it is not necessary that the cable direction be constant. the cable can change direction between points A, B, C and D. A traveler 301 as described with reference to FIG. 3 is shown riding the cable between the pass-through carriers at A and B. The traveler moves along the cable between pass-through carriers, and through the pass-through carriers, by virtue being pulled along by a tethered person or animal in some cases. In other uses pass-through carriers and travelers in embodiments of the invention may be used for many purposes, such as, for example, overhead conveyors, cable cars, and other heavy-duty applications, in some of which the traveler may be powered to move along the cable.

FIGS. 5 *a, b, c* and *d* illustrate how the traveler riding a cable interacts with a pass-through carrier according to an embodiment of the invention. In FIG. 5*a* traveler 301 has entered a pass-through carrier between rollers 103 and 104. Dotted circles 501 indicate the minimum diameter of each roller at the root of the groove in each roller. The tapered shape of traveler 301 guides the traveler between the rollers until the point shown where the diameter of the traveler is just large enough to touch the both rollers. At this point tongue 303 has not reached the rollers.

Figure 5B:
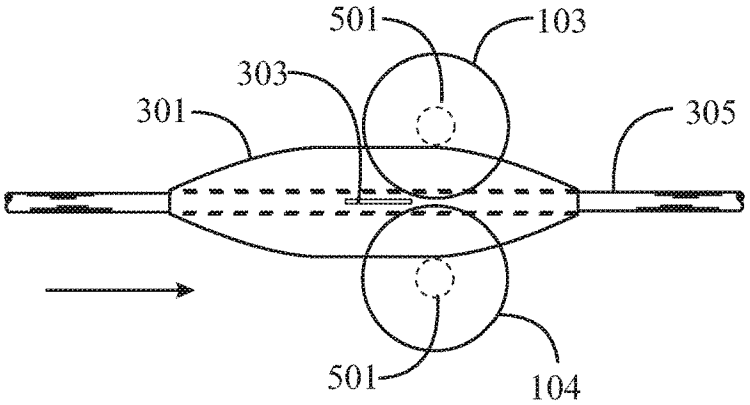

FIG. 5*b* illustrates the traveler has moved into the pass-through carrier to where the max diameter of the traveler has pushed roller 104 against the springs and opened a passage between the rollers for tongue 303, which may be seen just entering the area between the rollers.

Figure 5C:
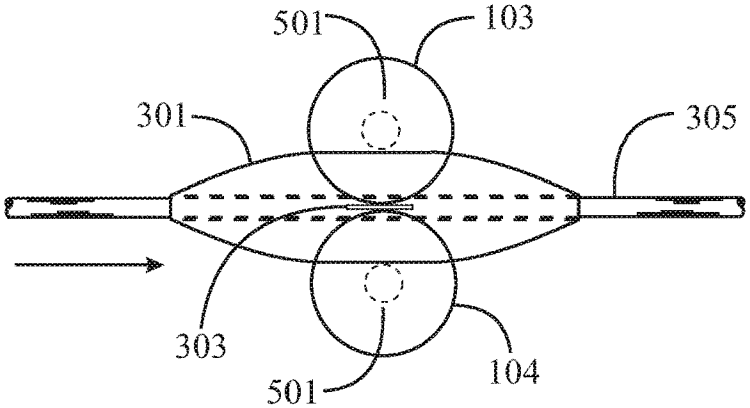

FIG. 5*c* illustrates a further movement of the traveler to where the traveler is one-half way through the rollers, and tongue 303 is moving through the gap between the rollers caused by the traveler opening the rollers.

Figure 5D:
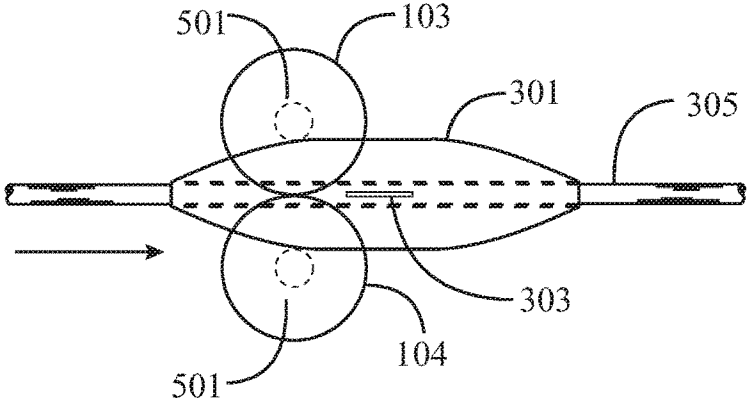

FIG. 5*d* illustrates the traveler having moved through the rollers to a point where the rollers are allowed to close to contact, and tongue 303 has cleared the rollers. The traveler may now move along the cable to the next pass-through carrier point.

The actual interaction between the traveler and the rollers is over a short distance, and in contact with the traveler, the rollers rotate rather than dragging on the traveler, which action facilitates the forward movement of the traveler. When the traveler passes through, the springs snap the rollers closed again, and help to push the traveler out of the pass-through carrier along the cable.

Figure 6B:
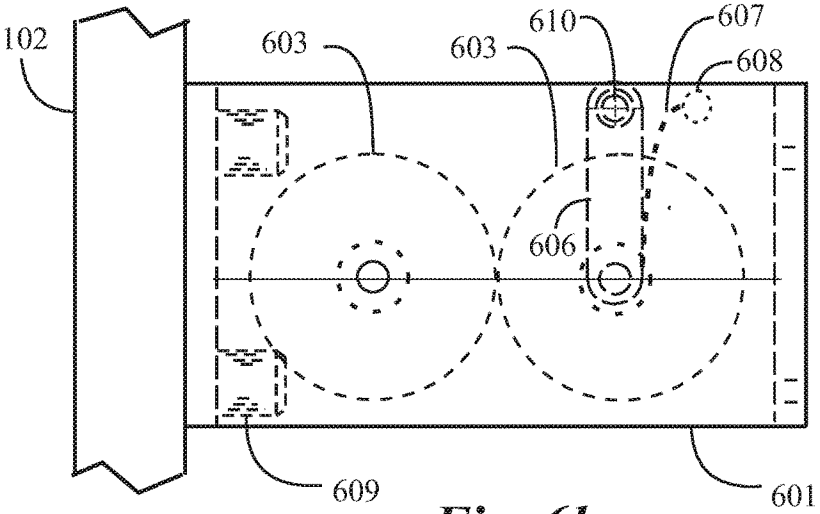
FIG. 6*a*, 6*b*, 6*c* illustrate a pass-through cable carrier in another embodiment of the invention.
Figure 6C:
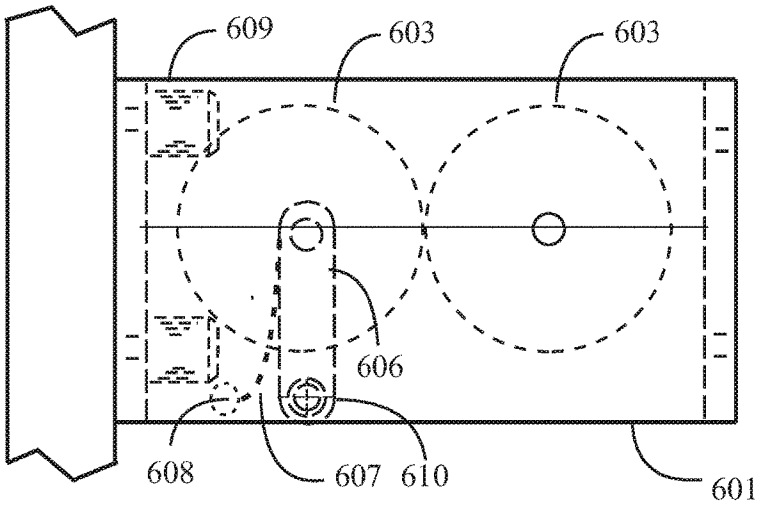
Figure 6A:
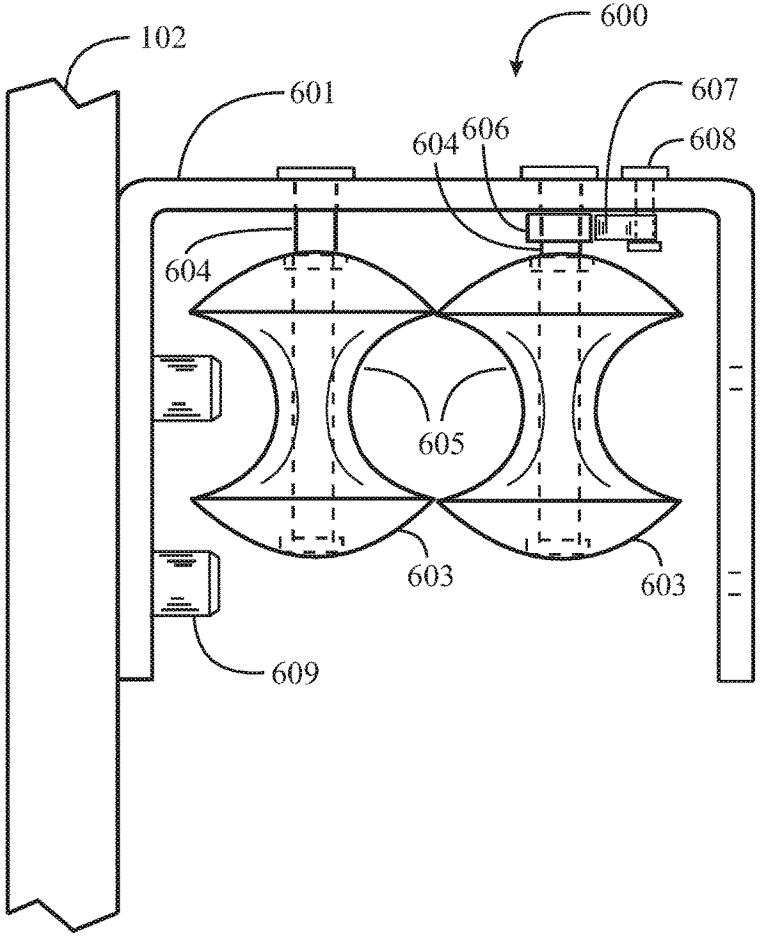

FIGS. 6*a, b*, and *c* illustrate a pass-through cable carrier according to another embodiment of the invention. In this example two spherical rollers 603*a* and 603*b* having grooves 605 the same as grooves 113 of rollers 103 and 104 in FIG. 1, are pivoted on shafts 604 beneath a horizontal portion of a frame bracket 601. One post 604 is pivoted in the top portion of bracket 601, and the other is pivoted at an end of a cantilever arm 606, which is pivoted in the top portion of bracket 601 at post 610. Arm 606 pivoting about post 610 enables roller 603*b* to move away from and toward roller 603*a*. A leaf spring 607 urges arm 606 in a direction that moves roller 603*b* toward and against roller 603*a*.

It will be apparent to the skilled person, having read the above descriptions of the apparatus of FIGS. 1-3, that the apparatus of FIG. 6*a* will operate in essentially the same manner as that of FIG. 1-3. In particular, referring now to FIGS. 5*a* through 5*d*, it should be apparent that a traveler 301 moved into and through rollers 603*a* and 603*b* will cause roller 603*b* to move away from roller 603*a* against leaf spring 607, so the opening formed by grooves 605 will define a circle the diameter of the traveler, and the traveler may pass, with the rollers rolling against the traveler.

An advantage of the apparatus of FIG. 6*a* is that it is substantially simpler and less bulky than that of FIGS. 1-3. FIGS. 6*b* and 6*c* illustrate a further advantage of the apparatus of FIG. 6*a*, which is the fact that bracket 601 may be bolted to support post or wall 102 as shown in FIG. 6*b*, wherein roller 603*b* moves away from support 102, and also as shown in FIG. 6*b*, such that roller 603*b* is closer to the support post, and moves in operation toward the support post rather than away.

The ability to reverse the operation of the pass-through carrier of FIG. 6*a* allows flexibility in providing cable runs over a plurality of pass-through carriers. Referring now back to FIG. 4, it may be seen that the cable run shown through A, B, C and D needs to have the pass-through carriers properly oriented to be able to apply substantial tension to cable 305. Consider the pass-through carrier at B, for example. With the cable in tension that carrier needs to have the roller to the outside (away from the post support) to be the roller that does not move, that is pivoted in the frame bracket. And the inner roller needs to be the roller that may move against spring pressure. The same is true at D, but the opposite is true at C. The interchangeable design shown as FIGS. 6*a*, 6*b* and 6*c* provide this flexibility.

It will be apparent to the skilled person that there are different ways that cantilever arm 606 may be implemented, and that there are a variety of ways that spring pressure may be applied to arm 606 to bias the arm and urge roller 603*b* toward roller 603*a*.

The apparatus thus far described, and the traveler, are relatively light-weight implementations useful for such as safety harnesses, dog runs, and the like. It is to be understood, however, that the same and similar mechanisms may be scaled for more demanding applications, such as cable car runs, overhead commercial conveyors and much more.

In one embodiment, in a more heavy-duty application, traveler 301 may be considerably larger, and may be mechanically driven along cable 305, having drive and power elements within an outer shell that provides the tapered in and out shape and a round cross-section centrally, so the traveler opens the rollers for pass-through, which than close as the mechanically driven traveler passes through.

Rollers in a pass-through cable carrier described above with reference to FIGS. 1 through 6*c* uniformly describe a system wherein the traveler has a round cross-section orthogonal to the direction of the traveler's motion on a cable, and rollers in the pass-through carriers that present a round aspect to the traveler in interaction. The roundness, however, is not a limitation in the invention. There are a variety of other shapes that travelers and compatible rollers might exhibit. As a single example, if grooves 113 as seen in FIG. 1 were, rather than having a circular radius, V-shaped grooves wherein opposite straight sides of the groove are at complementary angles with horizontal, so the V-shape points toward the axis of the roller, then a traveler, to be compatible, would have a square or a diamond shape in cross section, rather than round. The traveler shape would be square if the included angle of the groove were ninety degrees.

Referring now to FIG. 4, showing a cable system comprising several pass-through carriers, it was described above that the carriers might have either the inside or the outside roller movable against spring loading, depending on which way the cable turns toward the next carrier. IN such applications it is important that the cable from end to end remain in some tension. Sagging cable between carriers might well impede proper operation. The ensure tension on the cable, one or both ends of the cable, where anchored, may be anchored with strong tension springs to keep the cable in tension. Understanding that fatigue may cause stretching over time, one or more turnbuckles or similar devices may also be incorporated in a cable system.

Further to the above, in some applications the cable run may not be anchored at ends, but may be implemented as a moving cable with travelers constrained so they do not translate along the cable. IN this implementation the travelers may carry one or another of a variety of loads, such as a monorail, chairs of a ski lift, or a cable car. IN one implementation cable reels on each end may be operated to move a cable to translate the travelers through the pass-through cable carriers, or a system may have an endless aspect, so a cable run doubles back upon itself, and the cable is driven by geared or friction drives.

Referring again to FIGS. 1 and 6*a*-6*c*, two different means of providing relative movement between rollers in a carrier are illustrated and described. These are but two of a wider variety of mechanical means to accomplish this purpose. In another example, rollers may be mounted on bent and folded rods much as a paint roller is mounted, so the equivalent handle of the roller may be spring loaded and pivoted to allow the captured roller to move relative to a mating roller. Further, it is not necessary or a limitation that one roller be stationary and the other movable against a spring. Both rollers may move and be spring-loaded.

Further to the above, relative movement between two rollers is not the only way the pass-through of a traveler might be accomplished. In an alternative embodiment a carrier frame may be implements in a circular shape orthogonal to cable direction with a downward-facing opening for the tether of a traveler, an inside diameter of the frame being larger than the outside diameter of the traveler. In this embodiment a plurality of detents may be implemented in the inside diameter of the frame, the detents presenting spring-loaded balls toward a center of the circular aspect of the frame. The balls present a passage for the traveler with a somewhat smaller diameter than the traveler diameter, so a small retraction of the balls allows the traveler to pass.

In the implementation illustrated by FIG. 1 wherein one roller is mounted in a frame that may translate toward and away from the other roller, there are a variety of ways that the translating carriage may be constrained to translate, and in which spring pressure toward the other roller may be provided.

In another alternative two rollers of either the design of FIG. 1 or of FIG. 6, or other shapes, may be mounted on parallel shafts that extend to a coiled pattern above the rollers, the coils providing displacement under tension between the rollers. This mounting may be thought of as a "clothes-pin" mounting. In this embodiment the rollers do not move relative to one another with their axes parallel. In this implementation the framing may be such that the spring rate may be adjustable, and stops or rings may be provided to limit the separation of the rollers.

The embodiments described above are exemplary only, and do not describe every possible aspect and application of the invention, as many of the mechanisms may be implemented in a variety of ways. The scope of the invention is limited only by the claims that follow.

The invention claimed is:

1. A pass-through cable carrier apparatus, comprising:

a frame having a first vertical mounting surface enabled to mount securely to a vertical post, a wall, or other vertical support, and a horizontal portion connecting the first vertical mounting surface to a second vertical mounting surface, the first and second vertical mounting surfaces connected at opposite ends of the horizontal portion;

a first roller rotatable on a first vertical post anchored stationary relative to the first vertical mounting surface of the frame the first roller having a first circumferential groove symmetrical around a first central axis of the first vertical post and about a horizontal plane, the groove having a cross-section with a radius defining a substantial portion of a semicircle, but slightly less than a full semicircle;

a second roller including a second circumferential groove matching the semicircle and radius of the first groove of the first roller and rotatable on a second vertical post having a second central axis, the first and second central axes of the first and second vertical posts lying in a plane at a right angle to a mounting surface of the frame, the second roller mounted to be translatable against spring force away from the first roller; and a traveler having a body symmetrical about a third central axis, with a length and a circumference along a central portion of the length, the circumference having a radius equal to the radii of the grooves of the first and second rollers;

wherein the body further comprises a central bore along the third central axis, the bore having a circular entrance and exit formed by a circumference orthogonal to the third axis, through which a cable passes, the body passing through the pass-through cable carrier apparatus between the rollers; wherein the second vertical post is mounted in a translatable carriage guided by shafts in bores in a guide block, wherein the translatable carriage is urged toward the first rover by one or more springs.

2. The pass-through cable carrier apparatus of claim 1 wherein the first and the second rollers are cylinder shapes with the grooves cut to be symmetrical about a plane orthogonal to a central axis of the cylinder, leaving cylindrical lands above and below the grooves that may bear on one another when the rollers are directly adjacent to one another.

3. The pass-through cable carrier apparatus of claim 1 wherein the first and the second rollers are spherical shapes with the grooves cut to be symmetrical about a plane passing through a center of the spherical shape of each roller.

4. The pass-through cable carrier apparatus of claim 1 wherein the frame has two vertical mounting surface interfaces, one on each end of the horizontal portion, extending downward from the horizontal portion, enabling mounting to the wall, post or other vertical support, with the translatable roller nearer to the vertical support, or alternatively away from the vertical support.

5. The pass-through cable carrier apparatus of claim 1 wherein the traveler includes, a tapered shape from the central portion to each end of the body, a tongue extending from the central portion of the length of the body at a right angle to the central axis of the traveler, the tongue having a length along the body substantially less than the length of the central portion of the body, and a thickness substantially less than the diameter of the central portion of the body.

6. The pass-through cable carrier apparatus of claim 5 wherein the traveler is urged to pass between the rollers, such that a first tapered end of the tapered shape guides the traveler into contact with the grooves in the rollers, the rollers roll upon the traveler body when the central round portion of the traveler body is between the rollers, the traveler urges the rollers apart providing passage between the rollers for the tongue of the traveler while supporting the cable, and the tapered opposite end of the tapered shape allows the rollers to close as the traveler passes through, the closed rollers capturing and supporting the cable.

* * * * *